United States Patent [19]

Gonot, Jr. et al.

[11] 4,162,800

[45] Jul. 31, 1979

[54] COMBINATION BOOKMARK AND WRITING INSTRUMENT HOLDER

[76] Inventors: Fred P. Gonot, Jr., 86 W. Lane Ave., Apt. 1-G; Louis Kalliantas, 154 W. Sixth Ave., both of Columbus, Ohio 43201

[21] Appl. No.: 814,451

[22] Filed: Jul. 11, 1977

[51] Int. Cl.[2] ..... B42D 9/00

[52] U.S. Cl. ..... 281/42; 116/234; 281/48

[58] Field of Search ..... 281/1, 30, 42, 48; 116/119; D19/34; 224/28 A, 28 D; 24/3 A, 10 R, 11 R

[56] References Cited

U.S. PATENT DOCUMENTS

| | | | |
|---|---|---|---|
| 1,701,057 | 2/1929 | Thatcher | 24/3 A X |
| 1,894,093 | 1/1933 | Griffin | 116/119 UX |
| 2,066,992 | 1/1937 | Matson | 281/30 |
| 2,716,390 | 8/1955 | Goins | 281/42 |

*Primary Examiner*—Travis S. McGehee

[57] ABSTRACT

A combination elastic bookmark and holder for writing instruments is provided which functions to mark a location in a book and also releasably to secure a pen, pencil or other writing instrument or plurality thereof in a receiving holding means constituting a portion of the bookmark which may be preferably positioned on the exterior side of the book when in use. The portion of the combination bookmark and writing instrument holder which encircles the book is made of an elastic material so that it is adapted to hold securely a portion of the book in a separated position from the remainder of the portion of the book. The portion of the combination bookmark and writing instrument holder which is adapted to receive and hold the writing instrument may likewise be made of an elastic material and consists of two portions, each of which is adapted to receive and releasably hold the writing instrument at spaced positions along its length adjacent to the portion of the device which is used to separate the book pages.

1 Claim, 5 Drawing Figures

COMBINATION BOOKMARK AND WRITING INSTRUMENT HOLDER

This invention relates to a combination elastic bookmark and holder for writing instruments which will permit the bookmark to be attached to a variety of different sized books and which will also releasably hold the writing instruments so that they are unlikely to drop out of the holder in normal usage of the book, including some of the extremes to which books are subjected by young students.

In this day of casual dress and pocketless upper garments, especially as worn by students, there is no convenient place to carry a writing instrument or instruments. Consequently, students often reach their class with their books but without an appropriate writing instrument. Sometimes the writing instrument will be inserted in the book itself, thus damaging the book spline and eventually causing pages to fall out of the book.

A need also exists for a device of this type for salesmen, deliverymen, sales clerks, car owners, and others who need to mark a place in a book or pad and have a writing instrument readily accessible.

An object of the present invention is to provide a simple, practical and low cost combination means for marking a page location in a book or order pad which also constitutes a holder for one or more writing instruments.

Another object of the present invention is to provide such a combination bookmark and holder for writing instruments wherein the writing instruments are releasably secured to the holder and the book or pad divider portions of the combination means so as to be held in a secure relationship thereto during normal, or even extreme, usage of the book or pad by students or others.

Other objects of the invention in part will be obvious and in part pointed out more fully hereinafter.

In accordance with the present invention, a combination bookmark and writing instrument holder is provided which is characterized by a continuous flexible elastic ribbon of material which may be made of a knitted material, elastic material, may be extruded, may be sewn together, or otherwise joined together, or may be seamless, and which has affixed thereto a writing instrument holding and receiving portion. This portion generally consists of two parts, both extending across the width of the ribbon-like portion and spaced therefrom approximately 75% of the length of the average pen, pencil or other writing instruments. One portion of the writing instrument holding means may be in the shape of a pocket to receive and constrain one end of the writing instrument. A less expensive variation of this portion would only comprise an elastic strip which would not have a pocket portion. The other portion is an elastic strip which extends across the ribbon-like portion and permits the writing instrument to be inserted thereunder and in the case of a writing instrument which is equipped with a flexible clip, the clip may be placed over this portion so as more readily to secure the writing instrument in the writing instrument receiving holding means.

In the preferred embodiment of the present invention, the ribbon-like elastic portion is seamless and the writing instrument holder portions are attached thereto with an adhesive and there is a minimum expense involved in the construction of the device. In some simple versions of this invention, the ribbon-like portion has two pairs of transverse slits which function to form the writing instrument holding portions. Also, a variation of this includes two spaced single slits, so that the writing instrument is positioned between the book and the ribbon-like elastic portion. An additional variation includes a pair of transverse slits spaced from a single slit so that the writing instrument is positioned through the pair of slits with the point of the writing end of the writing instrument being placed under the single slit thus protecting the user from catching his clothing or fingers in the writing end of the writing instrument.

In the accompanying drawing representing an illustrative embodiment of this invention, FIG. 1 is an isometric view of the combination bookmark and writing instrument holder shown with a pen positioned in the writing instrument holding portion.

Figure 1:
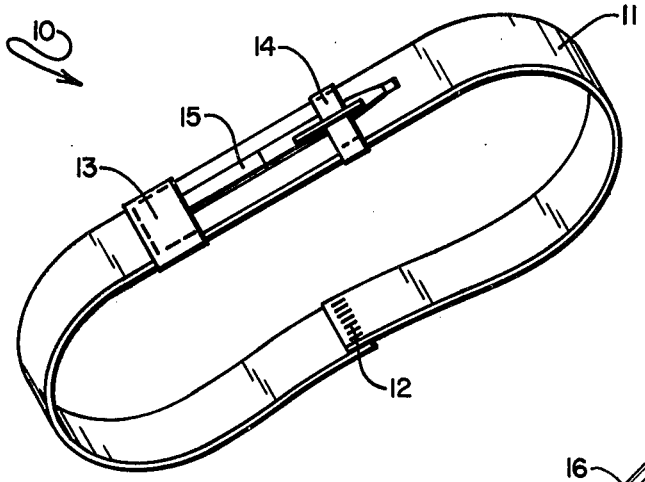

Referring now more particularly to the embodiment represented in the accompanying drawings, the combination bookmark and writing instrument holder designated generally by the reference numeral 10 is provided and combines an elastic portion 11 which preferably is in the form of a continuous ribbon of a size to enable it to fit the majority of books that are in use and which may be made from a seamless material or may be joined together with a seam as shown at 12.

One strap portion 13 of the writing instrument holder is attached to the ribbon-like material 11 and may be enclosed on three sides by stitching, adhesive, heat sealing or other suitable means, leaving a side open toward the other strap portion 14 of the writing instrument holder. If desired, portion 13 of the writing instrument holder may only be enclosed on the two sides adjacent the edges of the elastic portion 11. The portion 14, which is also preferably made from an elastic material, is attached at each of its extremeties to the elastic portion 11 by means of stiching, adhesive, heat sealing or other suitable means and is open at either end to permit a writing instrument such as is shown at 15 to be inserted thereunder so that one end of the writing instrument extends to and is held in the strap portion 13 which preferably is made from an elastic material. The other strap portion 14 of the writing instrument holder is located approximately 75% of the length of an average writing instrument from that end held by the writing instrument holding strap portion 13. The writing instrument is placed underneath the strap portion 14 and its writing end is inserted under the strap portion 13. In the case of a writing instrument such as a pen which is fitted with a clip, the clip may, if preferred, extend over the portion 14 so as to provide additional security to hold the writing instrument on the bookmark portion of the combination bookmark and writing instrument holder.

Figure 2:
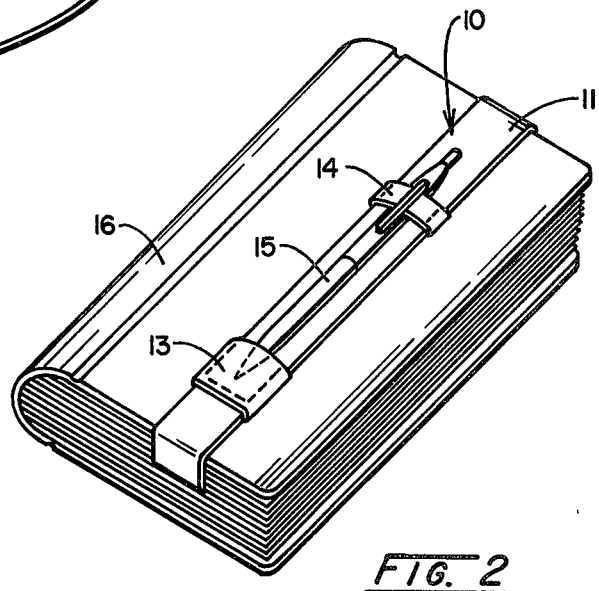
FIG. 2 is an isometric view of the combination bookmark and writing instrument holder in use on a book.

Referring now to FIG. 2, the combination bookmark and writing instrument and holder is shown generally at 10 and the ribbon-like material 11 is positioned so that it separates pages of the book 16 at the desired location and the strap portions 13 and 14 of the writing instrument holding portion of the combination bookmark and writing instrument holder removably engage the writing instrument 15.

Figure 3:
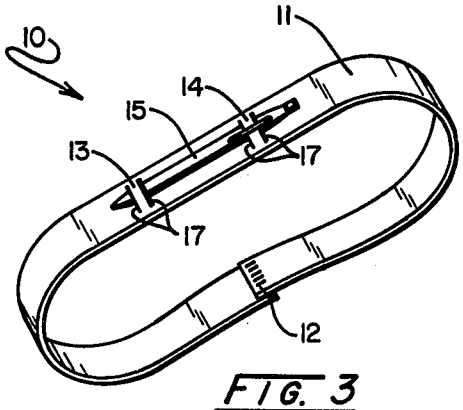
FIGS. 3, 4 and 5 are isometric views of variations of the combination bookmark and writing instrument holder of FIG. 1.

FIG. 3 shows a simple, more economical, version of the combination bookmark and writing instrument holder 10 wherein the writing instrument strap holders 13 and 14 are formed by providing two pairs of slits 17 in the elastic portion 11 permitting the writing instrument 15 to be inserted under the strap holders 13 and 14 and adjacent the elastic portion 11.

Figure 4:
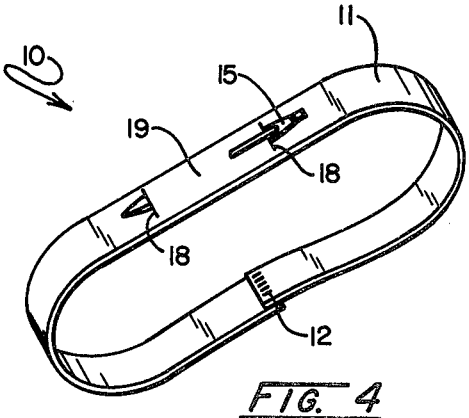

FIG. 4 shows an even more simplistic version of the combination bookmark and writing instrument holder 10 wherein the writing instrument strap holders 13 and 14 are replaced by two slits 18 in the elastic portion 11 permitting the writing instrument 15 to be inserted through the slits 18 under a portion 19 of the elastic portion 11 so that the writing instrument is firmly held in position against the book or pad.

Figure 5:
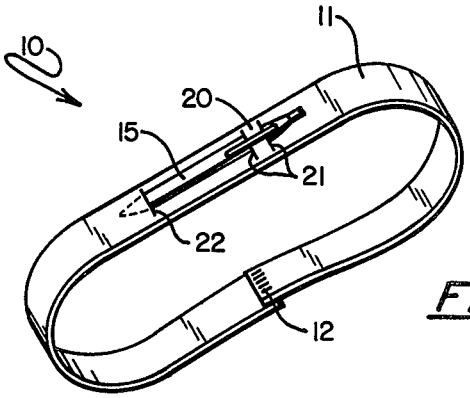

FIG. 5 shows a modification of the version of the combination bookmark and writing instrument holder shown in FIGS. 3 and 4 which provides for the writing end of the writing instrument 15 to be covered yet the combination bookmark and writing instrument holder to be manufactured at a minimum cost. The combination bookmark and writing instrument holder is shown generally at 10 and the writing instrument strap holder 20 is formed by providing two slits 21 in the elastic portion 11 while the portion adapted to hold the writing end of the writing instrument 15 is a single slit 22 so that the writing instrument may be inserted under the strap 20 and the writing end of the writing instrument 15 may be inserted into the slit 22 thus having the ribbon portion 11 protecting the point of the writing instrument 15. In the embodiment disclosed in this FIG. 5 all the desirable features of the embodiments shown in FIG. 1 are included at a minimum cost.

As the invention lends itself to many possible embodiments and as many possible changes may be made in this embodiment hereinbefore set forth, it will be distinctly understood that all matter described herein is to be interpreted as illustrative and not as a limitation.

I claim:

1. A combination bookmark and holder for writing instruments comprising a continuous ribbon of elastic material of a sufficient length so that said ribbon will fit snugly around the average book in a direction parallel to the spline of said book, of a width greater than the diameter of the writing instrument and wherein the length of said ribbon is substantially greater than its width and which ribbon is provided with at least two, spaced, slits (writing instrument receiving-means), extending transversely across the majority of the width of said ribbon releasably to hold a writing instrument in substantial alignment with the lengthwise dimension of said ribbon, while said ribbon functions as a bookmark.

* * * * *